US006907726B2

(12) United States Patent
Kim

(10) Patent No.: US 6,907,726 B2
(45) Date of Patent: Jun. 21, 2005

(54) EXHAUST SYSTEM FOR A V-TYPE ENGINE

(75) Inventor: Gyu Wan Kim, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/639,168

(22) Filed: Aug. 11, 2003

(65) Prior Publication Data

US 2004/0194456 A1 Oct. 7, 2004

(30) Foreign Application Priority Data

Apr. 7, 2003 (KR) ..... 10-2003-0021672

(51) Int. Cl.[7] ..... F01N 7/10
(52) U.S. Cl. ..... 60/323; 60/313
(58) Field of Search ..... 60/312, 313, 323, 60/324

(56) References Cited

U.S. PATENT DOCUMENTS 2,847,820 A * 8/1958 Leach ..... 60/323
5,398,504 A * 3/1995 Hirota et al. ..... 60/302
5,438,830 A * 8/1995 Matsumura ..... 60/302
6,182,447 B1 * 2/2001 Hashimura et al. ..... 60/323
6,374,600 B2 * 4/2002 Uegane et al. ..... 60/322

FOREIGN PATENT DOCUMENTS

JP 2001-227337 8/2001

* cited by examiner

*Primary Examiner*—Thomas Denion
*Assistant Examiner*—Diem Tran
(74) *Attorney, Agent, or Firm*—Morgan Lewis & Bockius LLP

(57) ABSTRACT

An exhaust system for a V-type engine according to the embodiment of the present invention includes first and second front exhaust pipes that are respectively connected to first and second exhaust manifolds upstream thereof through first and second front catalytic converters. The first and second front exhaust pipes are joined together at end portions thereof to form a coupling portion. The center exhaust pipe is connected downstream of the coupling portion, and a main catalytic converter is disposed in the center exhaust pipe. The rear exhaust pipe is connected downstream of the center exhaust pipe. The coupling portion is formed such that an angle between a center line of an end portion of the first front exhaust pipe and a center line of an end portion of the second front exhaust pipe is less than 20 degrees.

6 Claims, 4 Drawing Sheets

EXHAUST SYSTEM FOR A V-TYPE ENGINE

FIELD OF THE INVENTION

The present invention relates to an exhaust system for a V-type engine, and more particularly, to an exhaust system that is capable of improving exhaust gas flow uniformity characteristics by improving the structure of the coupling portion of front exhaust pipes that are disposed upstream of a main catalytic converter of the vehicle, and of maintaining a catalytic activating temperature of exhaust gas by additionally including a heat protector.

BACKGROUND OF THE INVENTION

Generally, an exhaust system of a vehicle is either a close-coupled catalytic converter (CCC) type or an underfloor catalytic converter (UCC) type according to disposition of a catalytic converter, considering engine compartment layout and the degree of exhaust gas reduction demand. In the CCC type, the catalytic converter is disposed close to each runner of an exhaust manifold, and in the UCC type, the catalytic converter is disposed relatively far from an exhaust manifold so that a demand for making exhaust gas flow uniform is relatively small.

There have been various directions in research and development for improving exhaust gas characteristics in such exhaust systems. Factors for improving exhaust gas characteristics can be summarized as follows: an improvement of flow uniformity upstream of a catalytic converter; a selection of a mounting position of an oxygen sensor; an improvement of a catalytic activating temperature during cold start; and a suppression of an increase of back pressure.

In the UCC exhaust system that is usually adopted for a V-type engine, first and second exhaust pipes are respectively coupled to exhaust manifolds through front catalytic converters. The first and second front exhaust pipes are joined together at a coupling portion.

However, in such a conventional exhaust system for a V-type engine, the first and second front exhaust pipes are typically perpendicularly coupled at the coupling portion, so flow of exhaust gas inside the coupling portion becomes irregularly turbulent. Furthermore, the sectional area of the exhaust line in the coupling portion substantially decreases so that a large pressure increase occurs in that portion, and this may cause an increase of back pressure, so that full load performance becomes deteriorated. Because the distance between the exhaust manifolds and the main catalytic converter 115 is large, exhaust gas temperature in the main catalytic converter may become lower than a catalyst activating temperature.

The information disclosed in this Background of the Invention section is only for enhancement of understanding of the background of the invention, and should not be taken as an acknowledgement or any form of suggestion that this information forms the prior art that is already known to a person skilled in the art.

SUMMARY OF THE INVENTION

Embodiments of the present invention provide an exhaust system for a V-type engine in which a coupling portion wherein first and second front exhaust pipes are joined together is improved, and a heat protector is used, to improve the flow uniformity characteristics of exhaust gas and full load performance and to maintain the exhaust gas temperature higher than a catalyst activating temperature.

In a preferred embodiment of the present invention, the exhaust system for a V-type engine comprises: first and second exhaust manifolds, first and second front exhaust pipes, a center exhaust pipe, and a rear exhaust pipe. The first and second front exhaust pipes are respectively connected to the first and second exhaust manifolds upstream thereof through first and second front catalytic converters, and the first and second front exhaust pipes are joined together at end portions thereof to form a coupling portion. The center exhaust pipe is connected downstream of the coupling portion, and a main catalytic converter is disposed in the center exhaust pipe. The rear exhaust pipe is connected downstream of the center exhaust pipe. The coupling portion is formed such that an angle between a center line of an end portion of the first front exhaust pipe and a center line of an end portion of the second front exhaust pipe is less than 20 degrees.

It is also preferable that the coupling portion is formed such that both an angle between a center line of the end portion of the first front exhaust pipe and a center line of the center exhaust pipe and an angle between a center line of the end portion of the second front exhaust pipe and a center line of the center exhaust pipe are less than 60 degrees.

Preferably, a slanted portion is formed at one end portion of the first and second front exhaust pipes, and a curved portion is formed at the other of the end portions, wherein the slanted portion and the curved portion are joined together to form the coupling portion.

It is further preferable that the coupling portion is positioned such that a distance between a vertical center line of the coupling portion and a vertical center line of the one of the first and second exhaust manifolds that is positioned farther from the main catalytic converter is more than 800 mm.

It is preferable that the exhaust system further comprises a main heat protector and an auxiliary heat protector. The main heat protector is disposed in the center exhaust pipe in the vicinity of the coupling portion, and the auxiliary heat protector is disposed in one of the first and second front exhaust pipes that is longer than the other.

In another preferred embodiment of the present invention, the exhaust system for a V-type engine comprises: first and second exhaust manifolds, first and second front exhaust pipes, a center exhaust pipe, and a rear exhaust pipe. The first and second front exhaust pipes are respectively connected to the first and second exhaust manifolds upstream thereof through first and second front catalytic converters, and the first and second front exhaust pipes are joined together at end portions thereof to form a coupling portion. The center exhaust pipe is connected downstream of the coupling portion, and a main catalytic converter is disposed in the center exhaust pipe. The rear exhaust pipe is connected downstream of the center exhaust pipe. The coupling portion is formed such that both an angle between a center line of the end portion of the first front exhaust pipe and a center line of the center exhaust pipe and an angle between a center line of the end portion of the second front exhaust pipe and a center line of the center exhaust pipe are less than 60 degrees.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

DETAILED DESCRIPTION OF THE PREFERRED EMBODIMENTS

Hereinafter, a preferred embodiment of the present invention will be described in detail with reference to the accompanying drawings.

Figure 1:
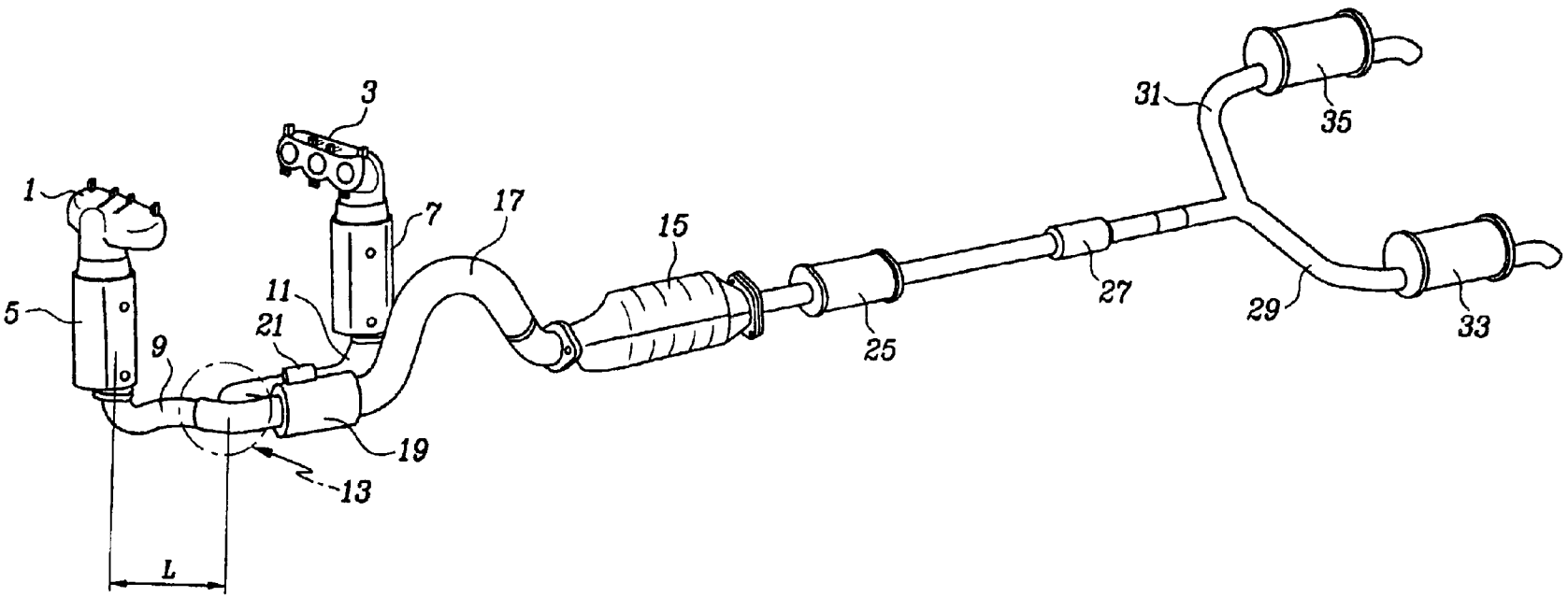
FIG. 1 is a perspective view of an exhaust system for a V-type engine according to a preferred embodiment of the present invention.

As shown in FIG. 1, an exhaust system for a V-type engine according to the preferred embodiment of the present invention includes left and right front exhaust pipes 9 and 11 that are respectively coupled to left and right exhaust manifolds 1 and 3, which are respectively coupled to cylinder heads of a V-type engine, through front catalytic converters 5 and 7.

The left and right front exhaust pipes 9 and 11 are joined together at a coupling portion 13, and the coupling portion 13 is connected upstream of a center exhaust pipe 17 including a main catalytic converter 15, a front muffler 25, and a center muffler 27.

Left and right rear exhaust pipes 29 and 31 are respectively coupled downstream of the center exhaust pipe 17, and left and right main mufflers 33 and 35 are respectively disposed in the left and right rear exhaust pipes 29 and 31.

Figure 2:
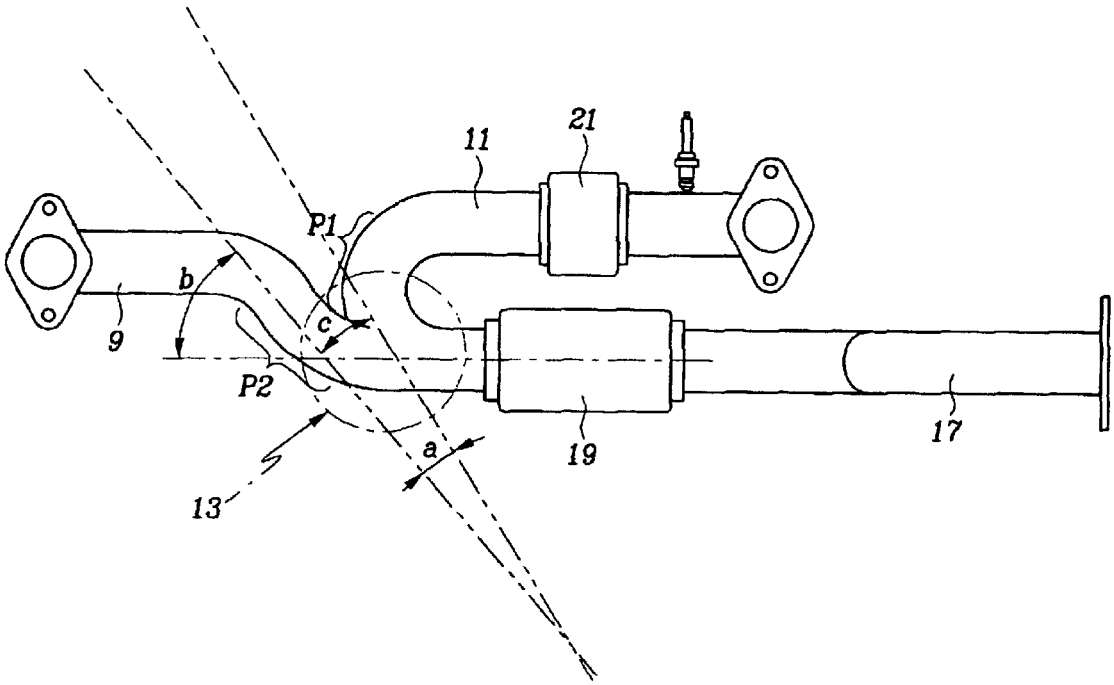
FIG. 2 is an enlarged view of a coupling portion of both front exhaust pipes of an exhaust system of FIG. 1.

As shown in FIGS. 1 and 2, a distance L between a vertical center line of the coupling portion 13 and a vertical center line of the left exhaust manifold 1 that is positioned farther from the center exhaust pipe 17 than the right exhaust manifold 3 is more than 800 mm. An angle a between a center line of an end portion of the left front exhaust pipe 9 and a center line of an end portion of the right front exhaust pipe 11 is less than 20 degrees.

Further, both an angle b between a center line of an end portion of the left front exhaust pipe 9 and a center line of the center exhaust pipe 17 and an angle c between a center line of an end portion of the right front exhaust pipe 11 and a center line of the center line of the center exhaust pipe 17 are less than 60 degrees. For this connection, the right front exhaust pipe 11 has a curved portion P1.

That is, in the exhaust system according to this embodiment, the left front exhaust pipe 9 is provided with a slanted portion P2 at an end portion thereof. An angle between a center line of the slanted portion P2 and the center line of the center exhaust pipe 17 is approximately 40 degrees (angle b). The right front exhaust pipe 11 is coupled to a front end of the center exhaust pipe 17 through the curved portion P1, and an angle between a center line of an end portion of the curved portion P1 and the center line of the center exhaust pipe 17 is approximately 55 degrees (angle c).

A main heat protector 19 is disposed in the center exhaust pipe 17 in the vicinity of the coupling portion 13 of the left and right front exhaust pipes 9 and 11, and an auxiliary heat protector 21 is disposed in the right front exhaust pipe 11 that is exposed to atmosphere more than the left front exhaust pipe 11 because of its longer length.

Each of the main heat protector 19 and the auxiliary heat protector 21 is a device to reduce transmission of heat of exhaust gas passing therethrough, and for example, it can be made of heatproof material.

Therefore, according to the exhaust system as stated above, because the coupling portion 13 of the left and right front exhaust pipes 9 and 11, which is positioned in front of the main catalytic converter 15, is positioned such that a distance L between a vertical center line of the coupling portion 13 and a vertical center line of the left exhaust manifold 1 is more than 800 mm, the angle between the center line of the slanted portion P2 of the left front exhaust pipe 9 and the center line of the end portion of the curved portion P1 of the right front exhaust pipe 11 is less than 20 degrees, and simultaneously the angle between the center line of the slanted portion P2 and the center line of the center exhaust pipe 17 and the angle between the center line of the end portion of the curved portion P1 and the center line of the center exhaust pipe 17 are respectively less than 60 degrees, uniformity of the flow of exhaust gas can be improved by minimizing interference between the flows of the exhaust gas, and full load performance can be improved by reducing the back pressure.

Figure 3:
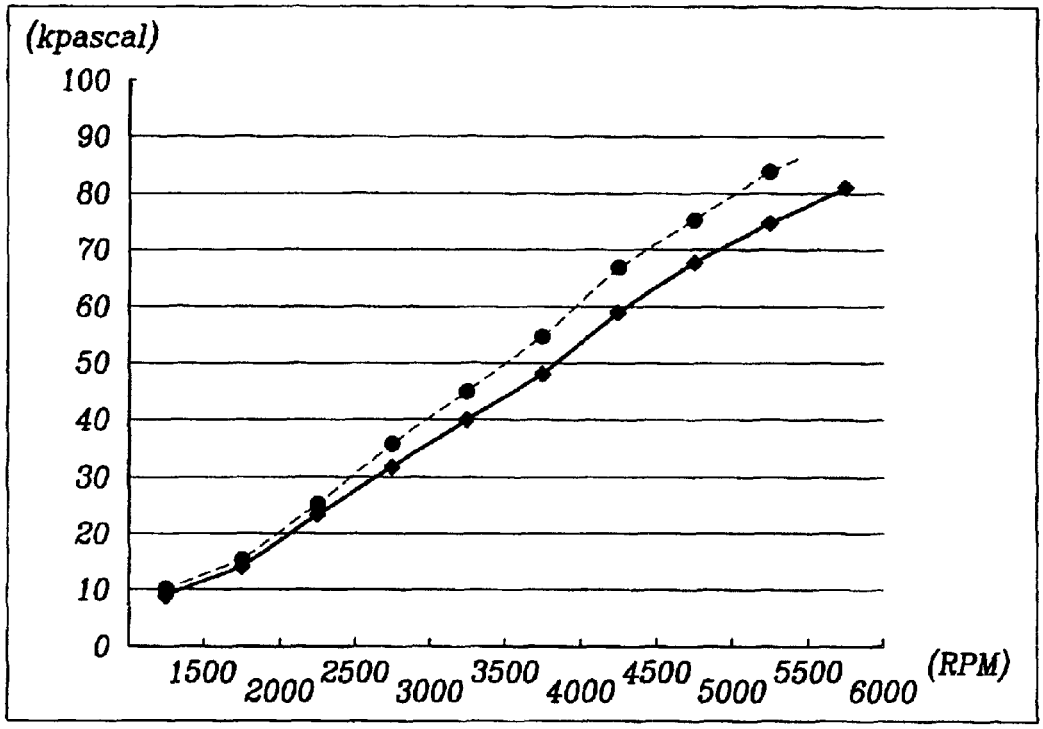
FIG. 3 illustrates back pressure characteristics of the exhaust system according to the preferred embodiment of the present invention.
Figure 4:
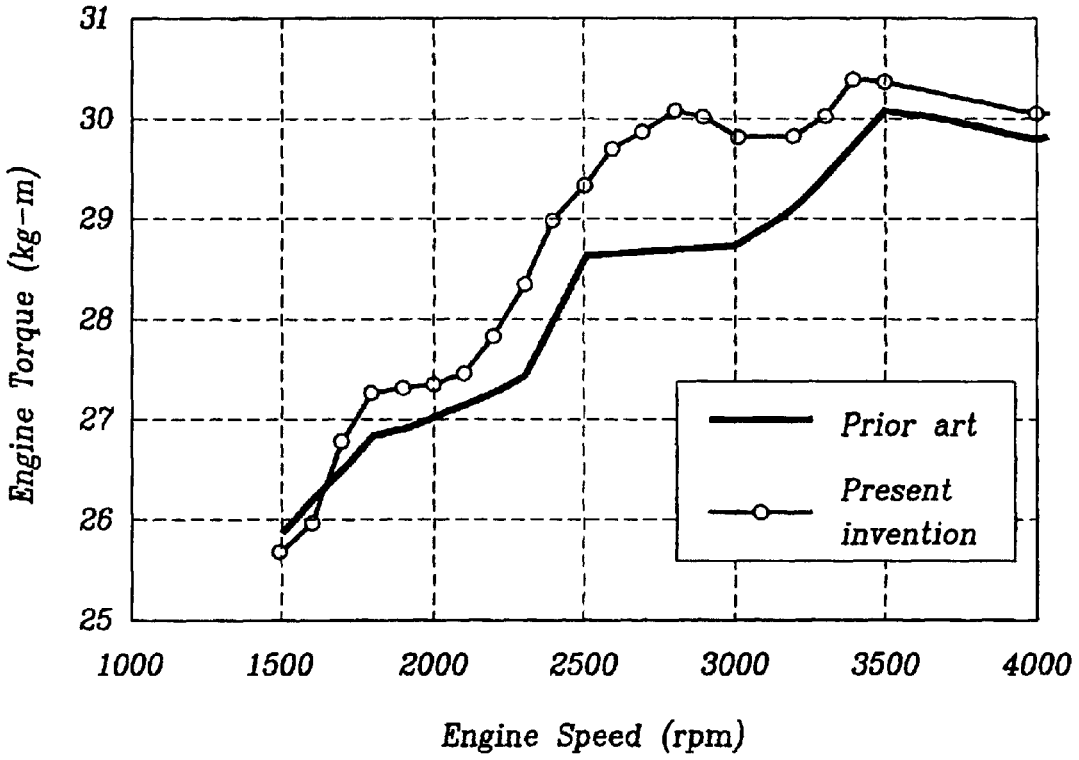
FIG. 4 illustrates performance of an engine adopting the exhaust system according to the preferred embodiment of the present invention.

Referring to FIG. 3, the solid line indicates back pressure upstream of the left or right front exhaust pipe 9 and 11 (downstream of one of the exhaust manifolds 1 and 3) corresponding to a change of engine RPM, and the dotted line indicates back pressure in the coupling portion 13 of the left and right front exhaust pipes 9 and 11 corresponding to a change of engine RPM. A back pressure difference between these two positions can be a measure of engine performance. That is, the lesser the difference, the higher the engine performance. As shown in FIG. 3, the difference in the back pressure is relatively small in the exhaust system according to the embodiment of the present invention. Consequently, as shown in FIG. 4, engine torque of an engine using the exhaust system according to the embodiment of the present invention is greater by a maximum of 4% than an engine using the exhaust system according to the prior art, in a range of 2500–3000 RPM, and in particular, engine performance is improved in a low RPM range.

Furthermore, the main heat protector 19 disposed in the center exhaust pipe 17 and the auxiliary heat protector 21 disposed in the right front exhaust pipe 11 prevent exhaust gas from being excessively cooled by heat transmission to atmosphere, so that exhaust gas temperature in the main catalytic converter 15 can be maintained higher than a catalyst activating temperature, and consequently, purification efficiency of the catalytic converter can be increased.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An exhaust system for a V-type engine, comprising:

first and second exhaust manifolds;

first and second front exhaust pipes respectively connected to the first and second exhaust manifolds upstream thereof through first and second front catalytic converters, the first and second front exhaust pipes being joined together at end portions thereof to form a coupling portion;

a center exhaust pipe connected to a downstream portion of the coupling portion, a main catalytic converter being disposed in the center exhaust pipe;

a main heat protector disposed in the center exhaust pipe in the vicinity of the coupling portion;

an auxiliary heat protector disposed in one of the first and second front exhaust pipes hat is longer than the other; and a rear exhaust pipe connected downstream of the center exhaust pipe, wherein the coupling portion is formed such that an angle between a center line of an end portion of the first front exhaust pipe and a center line of an end portion of the second front exhaust pipe is less than 20 degrees.

2. An exhaust system for a V-type engine, comprising:

first and second exhaust manifolds;

first and second front exhaust pipes respectively connected to the first and second exhaust manifolds upstream thereof through first and second front catalytic converters, the first and second front exhaust pipes being joined together at end portions thereof to form a coupling portion;

a center exhaust pipe connected to a downstream portion of the coupling portion, a main catalytic converter being disposed in the center exhaust pipe;

a main heat protector disposed in the center exhaust pipe in the vicinity of the coupling portion;

an auxiliary heat protector disposed in one of the first and second front exhaust pipes that is longer than the other; and a rear exhaust pipe connected downstream of the center exhaust pipe, wherein the coupling portion is formed such that both an angle between a center line of the end portion of the first front exhaust pipe and a center line of the center exhaust pipe, and an angle between a center line of the end portion of the second front exhaust pipe and a center line of the center exhaust pipe, are less than 60 degrees.

3. An exhaust system for a V-type engine, comprising:

first and second exhaust manifolds;

first and second front exhaust pipes respectively connected to the first and second exhaust manifolds upstream thereof through first and second front catalytic converters, the first and second front exhaust pipes being joined together at end portions thereof to form a coupling portion;

a center exhaust pipe connected to a downstream portion of the coupling portion, a main catalytic converter being disposed in the center exhaust pipe; and a rear exhaust pipe connected downstream of the center exhaust pipe, wherein the coupling portion is formed such that an angle between a center line of an end portion of the first front exhaust pipe and a center line of an end portion of the second front exhaust pipe is less than 20 degrees, wherein a main heat protector is disposed in the center exhaust nine in the vicinity of the coupling portion, and wherein an auxiliary heat protector is disposed in one of the first and second front exhaust pipes that is longer than the other.

4. The exhaust system of claim 3, wherein the coupling portion is formed such that both an angle between a center line of the end portion of the first front exhaust pipe and a center line of the center exhaust pipe, and an angle between a center line of the end portion of the second front exhaust pipe and a center line of the center exhaust pipe, are less than 60 degrees.

5. The exhaust system of claim 3, wherein a slanted portion is formed at one end portion of each of the first and second front exhaust pipes, and a curved portion is formed at the other end portions, and wherein the slanted portion and the curved portion are joined together to form the coupling portion.

6. The exhaust system of claim 3, wherein the coupling portion is positioned such that a distance between a vertical center line of the coupling portion and a vertical center line of one of the first and second exhaust manifolds that is positioned farther from the main catalytic converter than the other is more than 800 mm.

* * * * *